US006718708B2

(12) United States Patent
Donoghue

(10) Patent No.: US 6,718,708 B2
(45) Date of Patent: Apr. 13, 2004

(54) VERTICAL GLAZING FRAME SYSTEM FOR BUILDING CURTAIN WALLS WITH U-CHANNEL GLASS

(75) Inventor: James Donoghue, Butler, NY (US)

(73) Assignee: Bendheim Wall Systems, Inc., Passaic, NJ (US)

( * ) Notice: Subject to any disclaimer, the term of this patent is extended or adjusted under 35 U.S.C. 154(b) by 0 days.

(21) Appl. No.: 10/188,048

(22) Filed: Jul. 3, 2002

(65) Prior Publication Data

US 2004/0003553 A1 Jan. 8, 2004

(51) Int. Cl.[7] ..... E04H 1/00
(52) U.S. Cl. ..... 52/235; 52/202; 52/204.595
(58) Field of Search ..... 52/235, 204.595, 52/204.597, 204.7, 204.591, 460, 464, 466; 49/401, 501

(56) References Cited

U.S. PATENT DOCUMENTS 3,734,550 A * 5/1973 Vance ..... 403/34
4,141,188 A * 2/1979 Sukolics ..... 52/395
4,377,926 A * 3/1983 Coulston et al. ..... 52/309.3
4,768,316 A * 9/1988 Haas ..... 52/71
5,018,326 A * 5/1991 Reynolds ..... 52/235
5,036,637 A * 8/1991 Biebuyck ..... 52/235
5,235,790 A * 8/1993 Ishikawa et al. ..... 52/235
5,253,459 A * 10/1993 Parinas et al. ..... 52/235
5,546,713 A * 8/1996 Voegele et al. ..... 52/202
5,632,125 A * 5/1997 Osanai ..... 52/235
5,647,179 A * 7/1997 Hayashi et al. ..... 52/235

* cited by examiner

*Primary Examiner*—Ramon O. Ramirez
*Assistant Examiner*—Tan Le
(74) *Attorney, Agent, or Firm*—Arnold D. Litt

(57) ABSTRACT

A vertical glazing frame system for building curtain walls includes a sill assembly having a subsill shaped and dimensioned for direct attachment to a support structure and a sill shaped and dimensioned for receipt within the subsill for ease of installation and movement relative thereto. The system also includes a head assembly having a head receptor shaped and dimensioned for direct attachment to a support and a head shaped and dimensioned for receipt within the head receptor for movement relative thereto. The system further includes a jamb assembly and flashing plate extending over the sill assembly and the head assembly, the flashing plate including a first end coupled to the sill assembly and a second end covering the head assembly.

14 Claims, 4 Drawing Sheets

VERTICAL GLAZING FRAME SYSTEM FOR BUILDING CURTAIN WALLS WITH U-CHANNEL GLASS

BACKGROUND OF THE INVENTION

1. Field of the Invention

The invention relates to a window frame system. More particularly, the invention relates to a vertical glazing frame system for building curtain walls.

2. Description of the Prior Art

Relative movement between the building and windows utilized therewith causes many problems with regard to the structural integrity of the overall system. With this in mind, specific performance criteria have been established for building curtain walls as defined by the American Society for Testing Materials (ASTM and American Architectural Manufacturers Association (AAMA).

Prior systems have been prone to many problems including, but not limited to, seal breaks allowing moisture and air to enter a building and thermal breaks which separate or break from frames in which they are utilized. In view of the shortcomings found within the prior art, a need exists for a wall system allowing for the installation of windows in a manner which permits limited relative movement between the windows and the building. The present invention provides such a system

SUMMARY OF THE INVENTION

It is, therefore, an object of the present invention to provide a vertical glazing frame system for building curtain walls. The system includes a sill assembly having a subsill shaped and dimensioned for direct attachment to a support structure and a sill shaped and dimensioned for receipt within the subsill for ease of installation and movement relative thereto. The system also includes a head assembly having a head receptor shaped and dimensioned for direct attachment to a support and a head shaped and dimensioned for receipt within the head receptor for movement relative thereto. The system further includes a flashing plate extending over the sill assembly and the head assembly, the flashing plate including a first end coupled to the sill assembly and a second end covering the head assembly.

It is also an object of the present invention to provide a frame system wherein the subsill is U-shaped.

It is another object of the present invention to provide a frame system wherein the sill is U-shaped.

It is a further object of the present invention to provide a frame system wherein the head is U-shaped.

It is still another object of the present invention to provide a frame system including an insert positioned within the sill, the insert being shaped and dimensioned for supporting U glass.

It is yet a further object of the present invention to provide a frame system including at least one gasket positioned between the head receptor and the head.

It is also an object of the present invention to provide a frame system wherein the subsill sill, head receptor and head each include a centrally located thermal break.

It is also another object of the present invention to provide a frame system wherein fasteners are secured on opposite sides of the thermal break of the subsill when attached to a support structure and fasteners are secured on opposite sides of the thermal break of the head receptor when attached to a support structure.

It is still a further object of the present invention to provide a wail system for building curtain walls. The wall system includes a plurality of vertical glazing frame systems bridging floor slabs of a structure in which the wall system is installed and U glass extending between adjacent head assemblies and sill assemblies, wherein the U glass includes a first end seated within a sill and a second end seated within a head.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which maybe embodied in various forms. Therefore, the details disclosed herein are not to be interpreted as limited, but merely as the basis for the claims and as a basis for teaching one skilled in the art how to make and/or use the invention.

Figure 1:
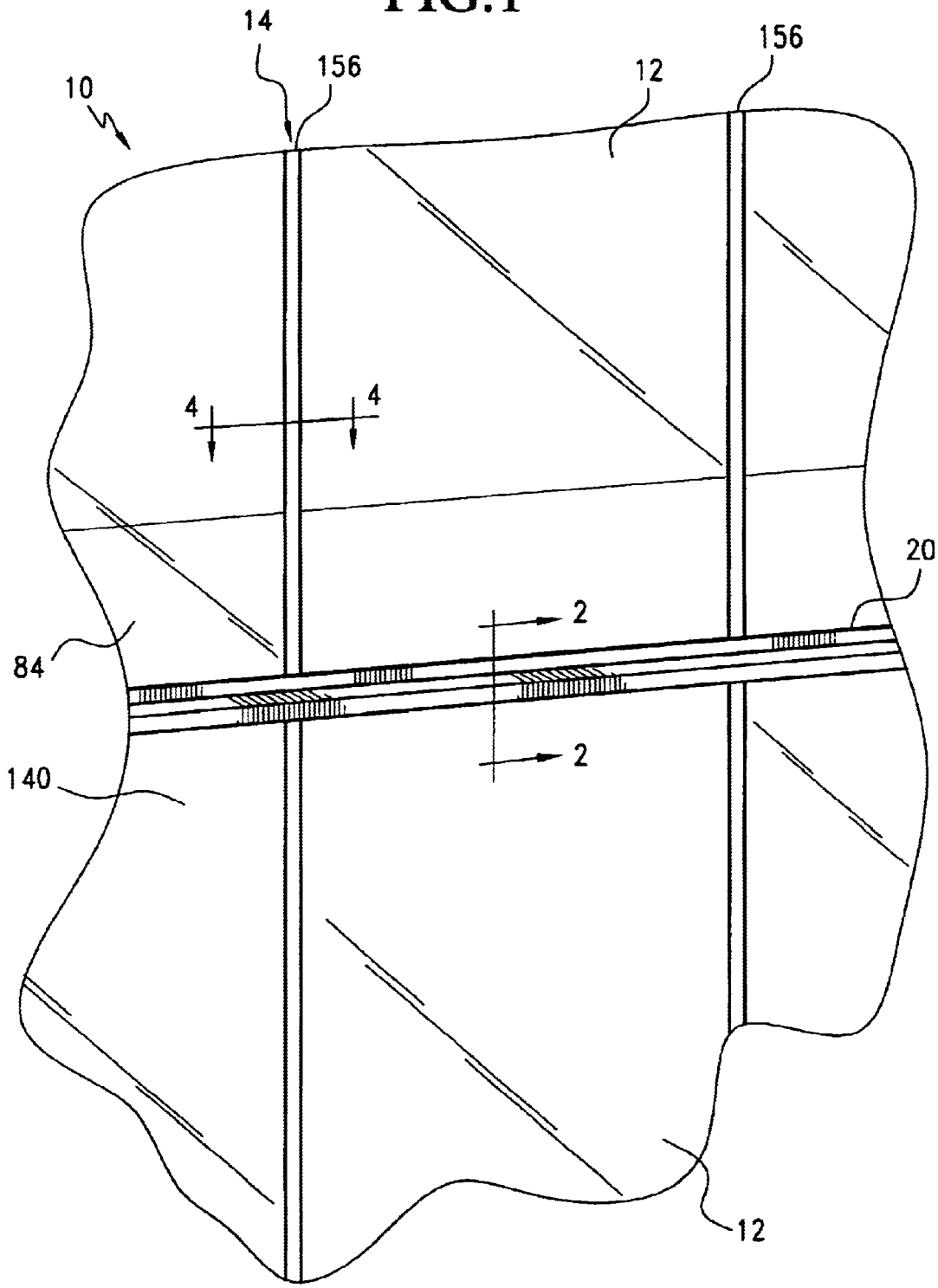
FIG. 1 is a perspective view of the present wall system
Figure 2:
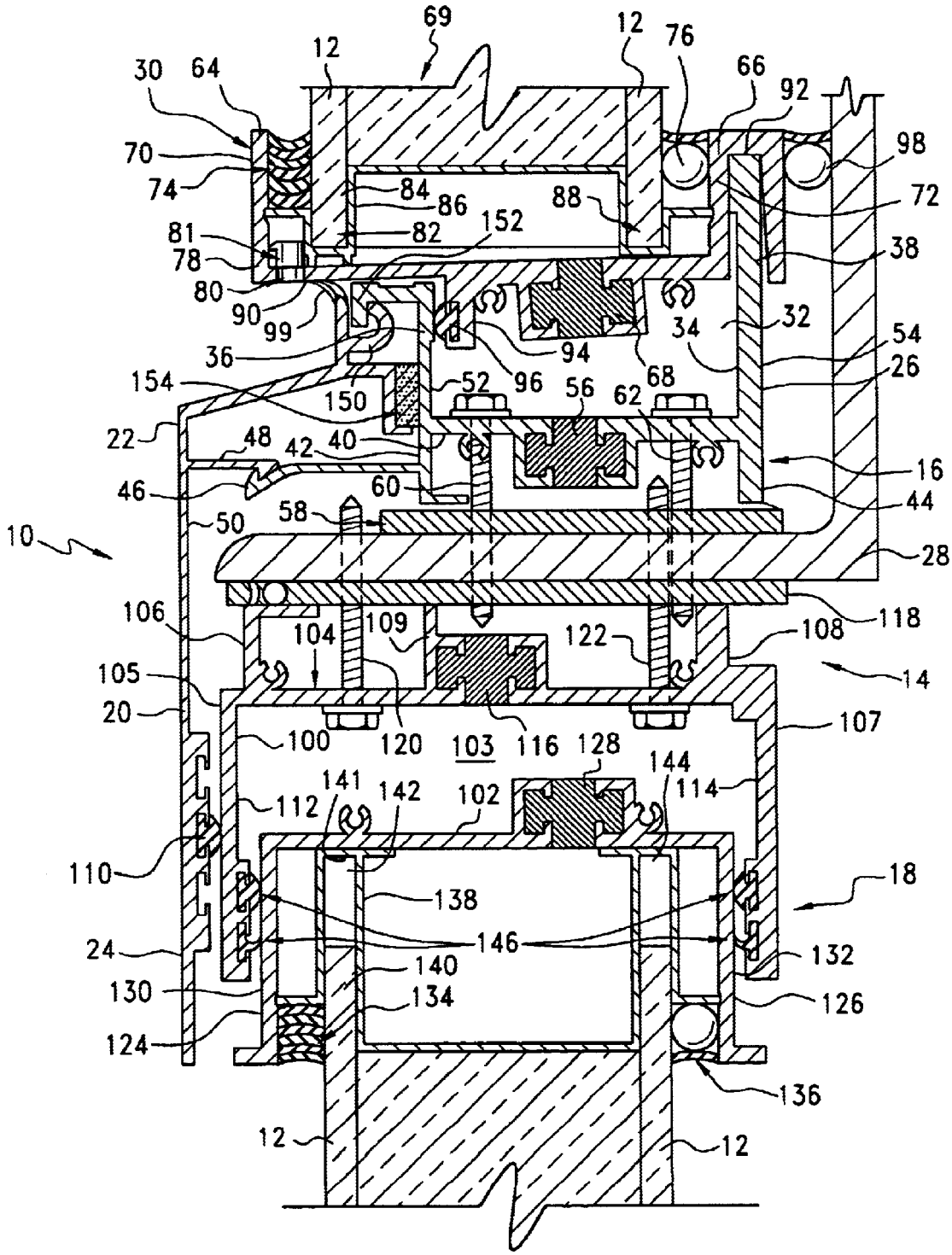
FIG. 2 is a cross sectional view along the line 2—2 of FIG. 1.
Figure 3:
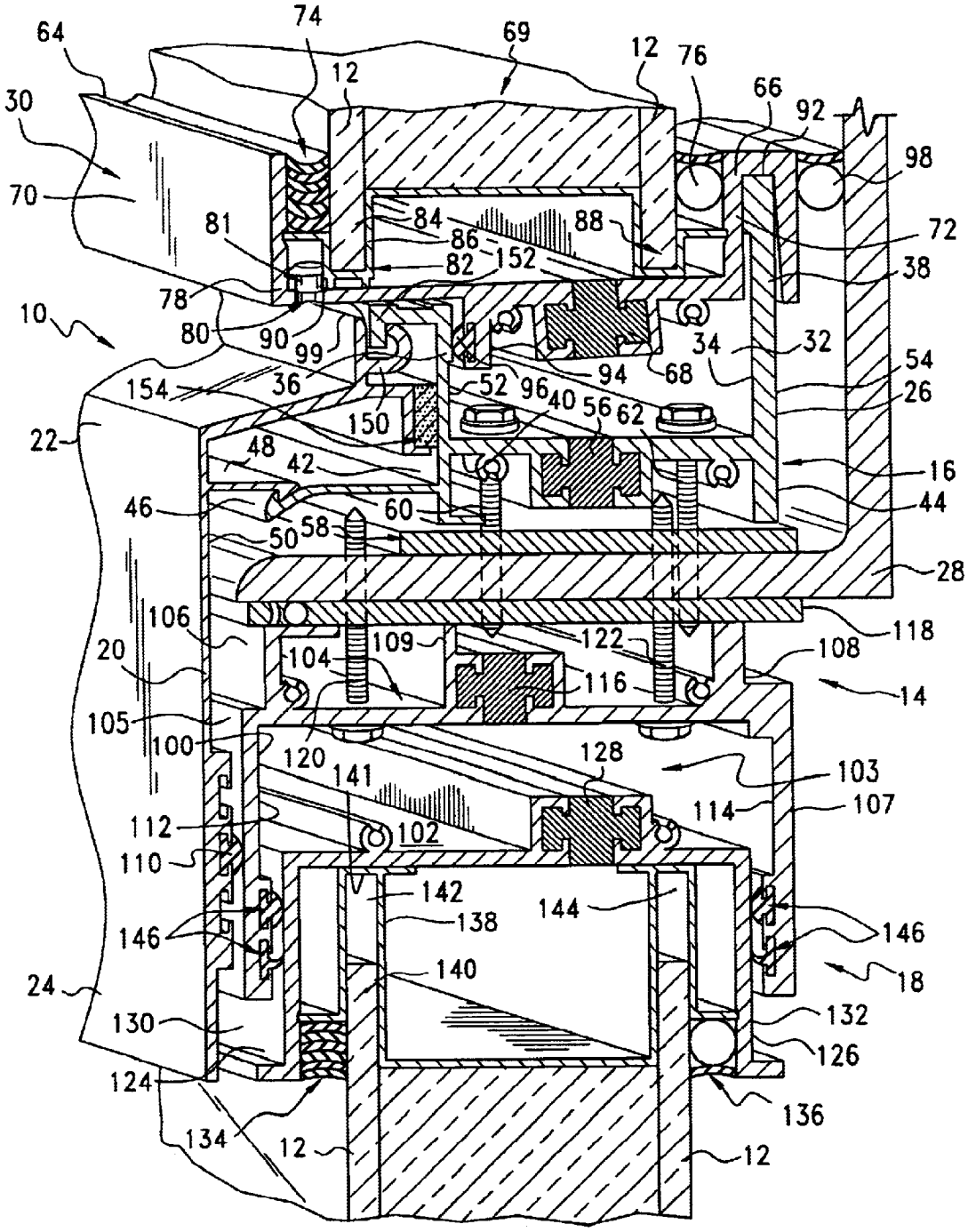
FIG. 3 is a cross sectional perspective view of the present wall system.

With reference to FIGS. 1, 2 and 3, a wall system 10 for building curtain walls is disclosed. The wall system 10 allows for the fabrication of vertical glazing within a curtain wall meeting U.S. performance criteria for building curtain walls as defined by the American Society for Testing Materials (ASTM) and American Architectural Manufacturers Association (AAMA). The wall system 10 achieves this goal by mounting U glass 12 within a frame system 14 such that the glass is free to move slightly when confronted with external forces. U glass is defined in European Standard, Part 7: Wired or unwired channel shaped glass, EN 572-7, November 1994, which is incorporated herein by reference.

In accordance with the present invention, such a wall system 10 is achieved by providing a plurality of vertical glazing frame systems 14 bridging floor slabs of a structure in which the wall system 10 is installed. Generally, each frame system 14 bridges a flooring slab by linking the sill assembly 16 of an upper floor to a head assembly 18 of the floor directly below.

Specifically, each frame system 14 includes a jamb assembly 156, a sill assembly 16, a head assembly 18 and a flashing plate 20 extending between the sill assembly 16 and the head assembly 18, wherein the flashing plate 20 includes a first end 22 coupled to the sill assembly 16 and a second end 24 resting against, and covering, the head assembly 18. In accordance with a preferred embodiment of the present invention, the structural elements of the jamb assembly, head assembly and the sill assembly are formed of extruded aluminum, the gaskets are formed of silicone and/or EPDM, and the thermal breaks are formed of urethane. However, those skilled in the art will appreciate the other materials which may be used without departing from the spirit of the present invention.

The sill assembly 16 includes a subsill 26 shaped and dimensioned for direct attachment to a support 28 and a sill 30 shaped and dimensioned for receipt within the subsill 26 for movement relative thereto. The subsill 26 is longitudinally extending and generally U-shaped in cross section. The subsill 26 includes a central recess 32 shaped and dimensioned for receiving at least a portion of the sill 30 therein. The U-shape of the subsill 26 provides for an upper surface 34 including an upwardly extending forward ledge 36 and an upwardly extending rear ledge 38 upon which the sill 30 sits in a manner which will be discussed below in greater detail The underside 40 of the subsill 26 includes first and second downwardly extending legs 42,44 shaped and dimensioned for engaging the support 28, for example, a structural steel support, to which the subsill 26 is secured. The second downwardly extending leg is set on the "high side" so that when the sill 30 is insert, the sill 30 will sit on an angle such that any moisture that enters the system will run out the front. The subsill 26 further includes a forward extending latch 46 shaped and dimensioned for engaging a similar latch 48 formed along the rear surface 50 of the flashing plate 20.

The subsill 26 is composed of first and second longitudinally extending members 52,54 linked by a centrally located, and similarly longitudinally extending, thermal break 56. The first longitudinally extending member 52, the second longitudinally extending member 54 and the thermal break 56 make-up the longitudinally extending subsill 26.

The subsill 26 is secured directly to the structural steel support 28 of the building. As shown, and in accordance with a preferred embodiment of the present invention, a shim 58 may be positioned between the subsill 26 and the structural steel support 28 to enhance positioning of the subsill 26 upon the structural steel support 28. Specifically, and in accordance with a preferred embodiment of the present invention, the subsill 26 is secured to the structural steel support 28 via a plurality of pairs of first and second screws 60, 62 applied along opposite sides of the thermal break 56. Pairs of first and second screws 60, 62 secure the subsill 26 to the structural steel support 28 at multiple points along the length of the subsill 26. By providing screws on both sides of the thermal break 56 the integrity of the system is enhanced in the event the thermal break 56 does in fact break or separate from either the first or second longitudinally extending members 52, 54.

As briefly mentioned above, the sill assembly 16 includes a sill 30 which sits within the subsill 26. By providing a two-piece sill assembly 16, the sill 30 is permitted to move independently of the subsill 26 and the building within which it is secured. This allows for building movement relative to the sill 30, or window 12 secured thereto. In addition, the two-piece sill assembly 16 allows for the utilization of a sill 30 which is never punctured by fasteners, therefore, preserving the seal integrity of the system As with the subsill 26, the sill 30 is a longitudinally extending member having a generally U-shaped cross section. The sill 30 is composed of first and second longitudinally extending members 64, 66 linked by a centrally located, and similarly longitudinally extending, thermal break 68. The first longitudinally extending member 64, the second longitudinally extending member 66 and the thermal break 68 makeup the longitudinally extending sill 30.

The U-shape of the sill 30 defines an upper surface 69 including an upwardly extending front wall 70 and an upwardly extending rear wall 72. The spacing between the upwardly extending front wall 70 and the upwardly extending rear wall 72 is determined so as to accommodate U glass 12 therebetween. U glass 12 is secured between the front wall 70 and rear wall 72 through the utilization of structural silicone 74 inserted between the front wall 70 and the U glass 12, as well as a foam backer rod 76 between the glass 12 and the rear wall 72. The forward edge 78 of the sill 30 adjacent the front wall 70 is provided with a weep hole 80 and cover 81.

Stable positioning of the glass 12 within the sill 30 is enhanced by the provision of an insert 82 at the lower edge 84 of the glass 12 between the sill 30 and the glass 12. The insert 82 is shaped to conform to the lower edge 84 of the glass 12 and is provided with first and second grooves 86,88 shaped and dimensioned to receive the glass 12 therein. In accordance with a preferred embodiment of the present invention, the insert is manufactured from PVC, although other comparable materials maybe used without departing from the spirit of the present invention.

Seating of the sill 30 upon the subsill 26 in a manner permitting relative movement therebetween is achieved through the provision of a forward underside 90 shaped and dimensioned to sit upon the upwardly extending forward ledge 36 of the subsill 26 and a downwardly facing rear recess 92 shaped and dimensioned to wrap about the upwardly extending rear ledge 38 of the subsill 26. Through the utilization of the forward underside 90 and the rear recess 92, the sill 30 securely sits upon the subsill 26 without the need for a rigid attachment therebetween.

Positioning of the sill 30 upon the subsill 26, and movement relative thereto, is further enhanced by the provision of a downwardly extending arm 94 extending from the underside of the sill 30. The downwardly extending arm 94 of the sill 30 extends substantially parallel to, and faces, the interior surface of the upwardly extending forward ledge 36 with a longitudinally extending gasket 96 positioned therebetween.

In addition, and in accordance with a preferred embodiment of the present invention, a foam backer rod 98 is positioned between the exterior wall of the rear recess 92 and the structural steel support 28. A silicon sealant 99 is used between the sill 30 and the flashing plate 20. However, and as those skilled in the art will certainly appreciate, use of such a sealant may only be necessary where the structural steel support extends as shown in accordance with the disclosed embodiment.

The head assembly 18 sits opposite the sill assembly 16 and is separated therefrom by the structural steel support 28 of the building within which the present system is secured. The head assembly 18 includes a head receptor 100 shaped and dimensioned for direct attachment to the support 28 and a head 102 shaped and dimensioned for receipt within the head receptor 100 for movement relative thereto.

The head receptor 100 is a longitudinally extending member which is generally U-shaped (downward facing) in cross section. The head receptor 100 includes a central recess 103 shaped and dimensioned for receiving at least a portion of the head 102 therein. The U-shape of the head receptor 100 provides for a downwardly facing surface including a downwardly extending front wall 105 and a downwardly extending rear wall 107 within which the head 102 sits in a manner which will be discussed below in greater detail. The upwardly facing side 104 of the head receptor 100 includes first, second and third upwardly extending legs 106, 108, 109 shaped and dimensioned for engaging the structural steel support 28 to which the head receptor 100 is secured. The exterior of the front wall 105 of the head receptor 100 is positioned so as to engage a gasket 110 extending from the rear surface of the flashing plate 20.

As with the subsill 26, the head receptor 100 is composed of first and second longitudinally extending members 112, 114 linked by a centrally located, and similarly longitudinally extending, thermal break 116. The first longitudinally extending member 112, the second longitudinally extending member 114 and the thermal break 116 make-up the longitudinally extending head receptor 100.

The head receptor 100 is secured directly to the structural steel support 28 of the building. As shown, and in accordance with a preferred embodiment of the present invention, a shim 118 may be positioned between the head receptor 100 and the structural steel support 28 to enhance positioning of the head receptor 100 upon the structural steel support 28. Specifically, and in accordance with a preferred embodiment of the present invention, the head receptor 100 is secured to the structural steel support 28 of a building in which the present system is installed. The head receptor 100 is secured to the structural steel support 28 first and second screws 120, 122 applied along opposite sides of the thermal break 116. First and second screws 120, 122 secure the head receptor 100 to the structural steel support 28 at multiple points along the length of the head receptor 100. By providing screws 120, 122 on both sides of the thermal break 116, the integrity of the system is enhanced in the event the thermal break 116 does in fact break or separate from either the first or second longitudinally extending members 112, 114.

As briefly mention above, the head assembly 18 includes a head 102 which sits within the head receptor 100. By providing a two-piece head assembly 18, the head 102 is permitted to move independently of the head receptor 100 and the building within which it is secured, allowing for building movement relative to the head 102 or window 12 secured thereto. In addition, the two piece head assembly 18 allows for the utilization of a head 102 which is never punctured by fasteners, therefore, preserving the seal integrity of the system As with the head receptor 100, the head 102 is a longitudinally extending member having a generally U-shaped cross section. The head 102 is composed of first and second longitudinally extending members 124,126 inked by a centrally located, and similarly longitudinally extending, thermal break 128. The first longitudinally extending member 124, the second longitudinally extending member 126 and the thermal break 128 make-up the longitudinally extending head 102.

The downwardly facing U-shape of the head 102 defines a downwardly facing surface including a downwardly extending front wall 130 and a downwardly extending rear wall 132. The spacing between the downwardly extending front wall 130 and the downwardly extending rear wall 132 is determined so as to accommodate U glass 12 therebetween. U glass 12 is secured between the front wall 130 and rear wall 132 through the utilization of structural silicone 134 inserted between the front wall 130 and the U glass 12, as well as a foam backer rod and silicone sealant 136 between the glass 12 and the rear wall 132.

Stable positioning of the glass 12 within the head 102 is enhanced by the provision of an insert 138 at the upper edge 140 of the glass 12 between the head 102 and the glass 12. The insert 138 is shaped to conform to the upper edge 140 of the glass 12 and is provided with first and second grooves 142, 144 shaped and dimensioned to receive the glass 12 therein. The insert 138 also maintains the glass 12 in proper position relative to the head 102. The insert further allows for ease of installation of the glass 12 in that the air space 141 provides space within which to slip the glass 12 into the head 102, and then up and into the sill 30. In accordance with a preferred embodiment of the present invention, the insert is manufactured from PVC, although other comparable materials may be used without departing from the spirit of the present invention.

Seating of the head 102 within the head receptor 100 in a manner permitting relative movement therebetween is achieved by manufacturing the head 102 such that it is slightly smaller than the recess defined by the front and rear walls 105, 107 of the head receptor 100, and fits therebetween in a manner permitting relative movement between the head receptor 100 and the head 102. Positioning of the head 102 within the head receptor 100, and controlled movement of the head 102 relative to the head receptor 100, is enhanced by the provision of longitudinally extending gaskets 146 along the interior surface of the head receptor 100. The gaskets engage the head 102, maintaining its positioning within the head receptor 100 but permitting movement relative thereto. Space 141 is provided between the head 102 and the upper edge 140 of the glass 12 so as to permit some vertical movement between the head 102 and the upper edge 140 of the glass 12.

As briefly discussed above, a flashing plate 20 extends between the sill assembly 16 and the head assembly 18, the flashing plate 20 including a first end coupled to the sill assembly 16 and a second end contacting the head assembly 18. In accordance with a preferred embodiment of the present invention, the flashing plate 20 is a longitudinally extending member formed of extruded aluminum. The flashing plate 20 includes an aesthetically pleasing exterior surface and rear surface shaped and dimensioned for engaging the sill assembly 16 and contacting the head assembly 18.

Specifically the flashing plate 20 is providing with three engaging elements for contact with the sill assembly 16. First, the flashing plate 20 is provided with an upwardly facing catch 150 within which a forward extending hook 152 of the subsill 26 sits for ensuring proper positioning of the flashing plate 20 relative to the subsill 26. The flashing plate 20 is further provided with a strip of tape 154 positioned for engaging the exterior surface of the forward ledge 36. In accordance with a preferred embodiment, the tape 154 is continuous closed cell tape, although other tapes maybe used without departing from the spirit of the present invention. Finally, and as discussed above, the flashing plate 20 includes a rear facing latch 48 shaped and dimensioned for engaging a similar latch 46 formed along the exterior surface of subsill 26.

As to the interaction between the flashing plate 20 and the head assembly 18, the flashing plate 20 is provided with at least one longitudinally extending gasket 110 which engages the exterior surface of the front wall 106 of head receptor 100 in a manner positioning the flashing plate 20 relative thereto while permitting movement relative thereto.

Figure 4:
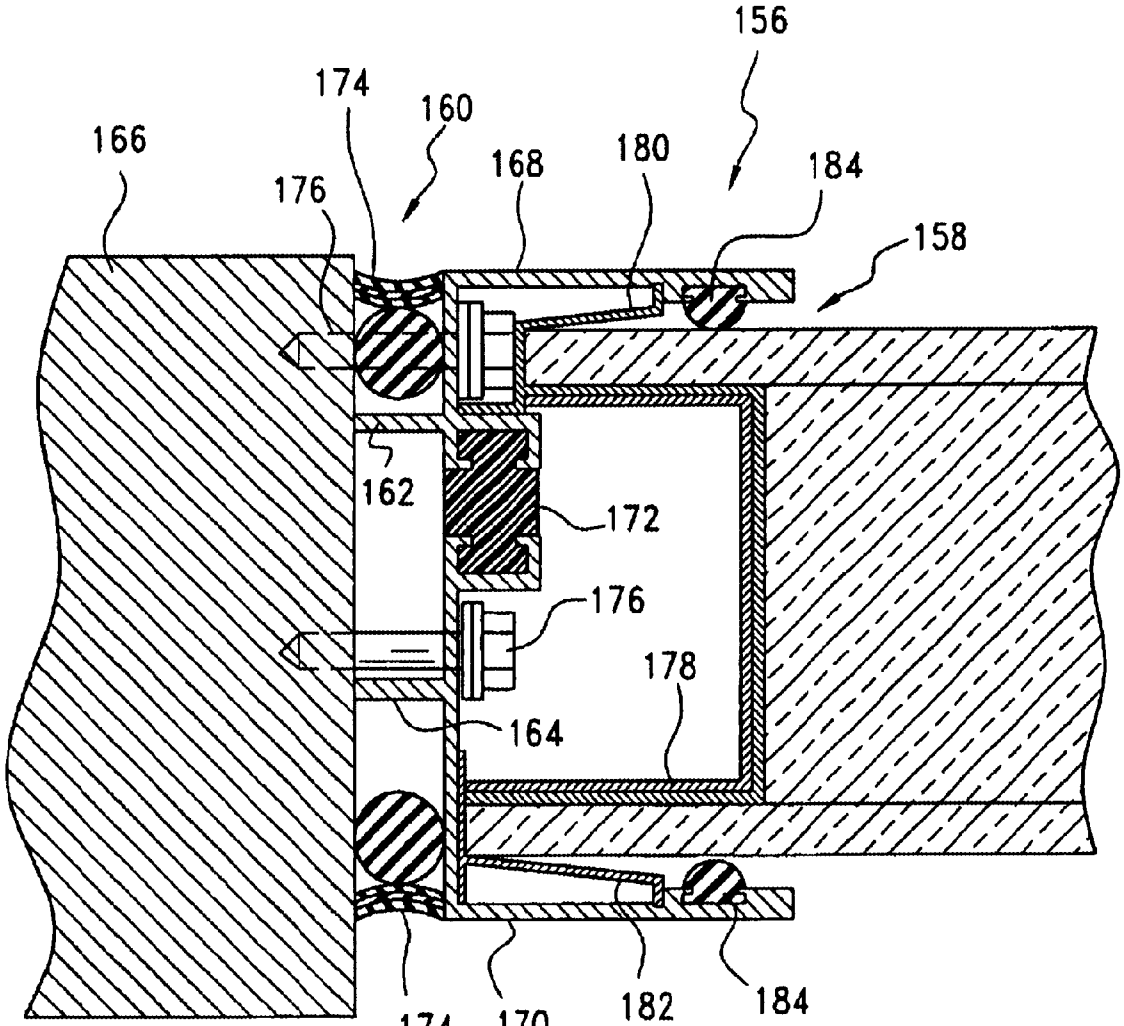
FIG. 4 is a cross sectional view along the line 4—4 of FIG. 1 showing the details of a jamb in accordance with the present invention.

Lateral support of the U glass 12 positioned between the head assemblies 18 and sill assemblies 16 is achieved through the provision of vertically oriented jambs 156 (see FIG. 4). The jambs 156 sit inside of the head and sill assemblies 18, 16 on either side of the opening, and tie the system 10 to the sides of the opening. Each of the jambs 156 is longitudinally extending and generally U-shaped in cross section. Each of jambs 156 includes a central recess 158 shaped and dimensioned for receiving the U glass 12 therein. The outside 160 of the jamb 156 includes first and second outwardly extending legs 162, 164 shaped and dimensioned for engaging a building support 166 to which the jamb 156 is secured.

The jamb 156 further includes first and second longitudinally extending members 168, 170 linked by a centrally located, and similarly longitudinally extending, thermal break 172. The first longitudinal extending member 168, the second longitudinally extending member 170 and the thermal break 172 makeup the longitudinally extending jamb 156.

The jamb 156 is secured directly to the support 166 of the building. As shown, and in accordance with a preferred embodiment of the present invention, sealing members 174 may be positioned between the jamb 156 and the support 166 to enhance sealing of the jamb 156 upon the support 166. Specifically, and in accordance with a preferred embodiment of the present invention, the jamb 156 is secured to the support 166 via screws 176 positioned on opposite sides of the thermal break 172.

Stable positioning of the U glass 12 within the jamb 156 is enhanced by the provision of an insert 178 between the jamb 156 and the U glass 12. The insert 178 is shaped to conform to the lateral edge of the U glass 12 and is provided with first and second grooves 180, 182 shaped and dimensioned to receive the U glass 12 therein. The insert 178 may be manufactured in various shapes in order to accommodate different U-channels. In accordance with a preferred embodiment of the present invention, the insert is manufactured from PVC although other comparable materials may be used without departing from the spirit of the present invention. Positioning of the U glass 12 within the jamb 156 is further facilitated by the inclusion of gaskets 184 between the jamb and the U glass 12.

The system is completed by the inclusion of one or two piece(s) of U glass 12 extending between adjacent head assemblies 18 and sill assemblies 16. That is, the glass includes a first end seated within a sill of a first frame system, while the second end of the glass is seated within a head of a second frame system. For example, the first end of the glass might sit within a sill of a first frame system extending between the third and fourth floor of a building while the second end of the glass might sit within a head of a second frame system extending between the fourth and fifth floor of a building.

The provision of the present frame system 14 facilitates the independent movement between the building and either the head 102 or sill 30 without breaking air and water seals. The present system further provides a wall system, as opposed to a framed window, through the utilization of a flashing plate extending between the head assembly 18 and the sill assembly 16.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A vertical glazing frame system for building curtain walls, comprising:

a sill assembly including a subsill shaped and dimensioned for direct attachment to a support structure and a sill shaped and dimensioned for receipt within the subsill for movement relative thereto;

a head assembly including a head receptor shaped and dimensioned for direct attachment to a support and a head shaped and dimensioned for receipt within the head receptor for movement relative thereto;

a flashing plate extending over the sill assembly and the head assembly, the flashing plate including a first end coupled to the sill assembly and a second end covering the head assembly;

wherein said frame system includes at least one gasket positioned between the head receptor and the head;

wherein the subsill, sill, head receptor and head each include a centrally located thermal break; and wherein fasteners are secured on opposite sides of the thermal break of the subsill when attached to a support structure and fasteners are secured on opposite sides of the thermal break of the head receptor when attached to a support structure.

2. The frame system according to claim 1, wherein the subsill is U-shaped to hold the sill.

3. The frame system according to claim 2 wherein the sill is U-shaped.

4. The frame system according to claim 1, wherein the head receptor is U-shaped to receive the head.

5. The frame system according to claim 4, wherein the head is U-shaped.

6. The frame system according to claim 1, further including an insert positioned within the sill, the insert being shaped and dimensioned for supporting U glass.

7. The frame system according to claim 1, further including an insert position positioned with the head, the insert being shaped and dimensioned for supporting and positioning U glass.

8. A wall system for building curtain walls, comprising:

a plurality of vertical glazing frame systems bridging floor slabs of a structure in which the wall system is installed, each frame system including:

a sill assembly including a subsill directly secured to a support structure and a sill shaped and dimensioned for receipt within the subsill for movement relative thereto;

a head assembly including a head receptor directly secured to a support and a head shaped and dimensioned for receipt within the head receptor for movement relative thereto;

a flashing plate extending over the sill assembly and the head assembly, the flashing plate including a first end coupled to the sill assembly and a second end covering the head assembly;

U glass extending between adjacent head assemblies and sill assemblies, wherein the U glass includes a first end seated within a sill and a second end seated within a head;

wherein said frame system includes at least one gasket positioned between the head receptor and the head;

wherein the subsill, sill, head receptor and head each include a centrally located thermal break; and wherein fasteners are secured on opposite sides of the thermal break of the subsill when attached to a support structure and fasteners are secured on opposite sides of the thermal break of the head receptor when attached to a support structure.

9. The wall system according to claim 8, wherein the subsill is U-shaped.

10. The wall system according to claim 9, wherein the sill is U-shaped.

11. The wall system according to claim 8, wherein the head receptor is U-shaped.

12. The wall system according to claim 11, wherein the head is U-shaped.

13. The wall system according to claim 8, further including an insert positioned within the sill, the insert being shaped and dimensioned for supporting U glass.

14. The wall system according to claim 8, further including an insert positioned with the head, the insert being shaped and dimensioned by supporting U glass.

* * * * *